US006940472B2

(12) United States Patent
Peng

(10) Patent No.: US 6,940,472 B2
(45) Date of Patent: Sep. 6, 2005

(54) UNIVERSAL ANTENNA ADAPTER

(75) Inventor: Wen-Yu Peng, Hsinchu (TW)

(73) Assignee: Gemtek Technology Co., Ltd., Hsinchu (TW)

( * ) Notice: Subject to any disclaimer, the term of this patent is extended or adjusted under 35 U.S.C. 154(b) by 13 days.

(21) Appl. No.: 10/707,458

(22) Filed: Dec. 16, 2003

(65) Prior Publication Data

US 2005/0030252 A1 Feb. 10, 2005

(51) Int. Cl.[7] ..... H01Q 1/50
(52) U.S. Cl. ..... 343/906; 343/702
(58) Field of Search ..... 343/702, 715, 343/880, 882, 906

(56) References Cited

U.S. PATENT DOCUMENTS 4,190,840 A * 2/1980 Liautaud ..... 343/715
5,524,284 A * 6/1996 Marcou et al. ..... 455/575.7
5,535,274 A * 7/1996 Braitberg et al. ..... 379/446
6,544,075 B1 * 4/2003 Liao ..... 439/638
2005/0049014 A1 * 3/2005 Nelson ..... 455/575.1

* cited by examiner

*Primary Examiner*—Tho Phan
(74) *Attorney, Agent, or Firm*—Jianq Chyun IP office

(57) ABSTRACT

A universal antenna adapter suitable for engaging with a fixed antenna and a detachable antenna is provided. The universal antenna adapter comprises a circular opening, a latching hook structure and a fixed spring plate. The latching hook structure is set around the circular opening for interfering with a latching spring plate on the fixed antenna. The fixed spring plate is set on an interior surface of the universal antenna adapter. The fixed spring plate engages with an antenna connector of the detachable antenna so that the antenna connector is prevented from moving forward and backward. The latching hook structure comprises a pair of symmetrical split sections for gripping and latching the antenna connector so that the antenna connector is prevented from rotation and up/down movement.

7 Claims, 7 Drawing Sheets

UNIVERSAL ANTENNA ADAPTER

BACKGROUND OF INVENTION

1. Field of the Invention

The present invention relates to an antenna connector. More particularly, the present invention relates to a universal antenna adapter suitable for engaging a fixed antenna as well as a detachable antenna.

2. Description of the Related Art

Wireless radio transmission is one of most common technique for sending and receiving messages. To name few, our radios, wireless televisions, satellite phones, cellular phones and wireless local area network involves radio transmission. All these devices that demand the transmission and reception of radio signals are often referred to as wireless radio devices.

Typically, wireless radio devices uses an antenna to facilitate the transmission or the reception of signals. In general, the antenna used by a wireless radio device can be classified as a built-in antenna and an external antenna. A wireless radio device using an external antenna normally has an antenna connector for engaging with an external antenna. Currently, the most common types of external antennas include the fixed antennas and the detachable antennas. Accordingly, antenna connectors can be classified into fixed antenna connectors and detachable antenna connectors.

At present, a fixed antenna connector accepts the engagement of a fixed antenna and a detachable antenna connector accepts the engagement of a detachable antenna only. Since fixed antennas and detachable antennas cannot be interchangeable, a wireless radio device installed with a fixed antenna connector can only use a fixed antenna. Similarly, a wireless radio device installed with a detachable antenna connector can only use a detachable antenna. With this limitation, mechanical compatibility between the antenna and the wireless radio devices is severely restricted. Furthermore, the manufacturers have to procure one set of molds for producing the fixed antenna connectors and another set of molds for fabricating the detachable antenna connectors leading to an increase in overall production cost.

SUMMARY OF INVENTION

Accordingly, one object of the present invention is to provide a universal antenna adapter suitable for engaging with a fixed antenna and a detachable antenna. Hence, a wireless radio device installed with the universal antenna adapter is physically compatible with both types of antennas.

A second object of this invention is to provide a universal antenna adapter suitable for engaging with a fixed antenna and a detachable antenna so that only a single set of molds for fabricating the connector is required.

To achieve these and other advantages and in accordance with the purpose of the invention, as embodied and broadly described herein, the invention provides a universal antenna adapter suitable for engaging with a fixed antenna and a detachable antenna. The universal antenna adapter comprises a body casing, a base plate and a cover plate. One side of the body casing has a circular opening for receiving a circular plug attached to a fixed antenna or an antenna connector of a detachable antenna. A latching hook structure is set on an interior sidewall of the body casing around the circular opening. A latching spring plate is set at the end of the circular plug of the fixed antenna. When the circular plug of the fixed antenna is plugged into the circular opening of the body casing, the latching spring plate and the latching hook structure are locked together so that the fixed antenna is fastened to the universal antenna adapter reliably.

Furthermore, a fixed spring plate structure is set on an interior surface of the body casing for latching with the antenna connector to prevent the antenna connector from moving forward and backward. In addition, the latching structure comprises two detachable but symmetrical sections for gripping and latching with the antenna connector to prevent the antenna connector from rotating and moving up and down. The antenna connector can pass through the circular opening and screw onto one end of the antenna body for engaging the detachable antenna with the universal antenna adapter.

Accordingly, the universal antenna adapter of this invention is suitable not only for engaging with a fixed antenna, but is also suitable for engaging with a detachable antenna. Hence, the wireless radio device installed with this universal antenna adapter has greater mechanical compatibility for antennas. Moreover, only one set of production molds is required so that the production cost of the universal antenna adapter is lower.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
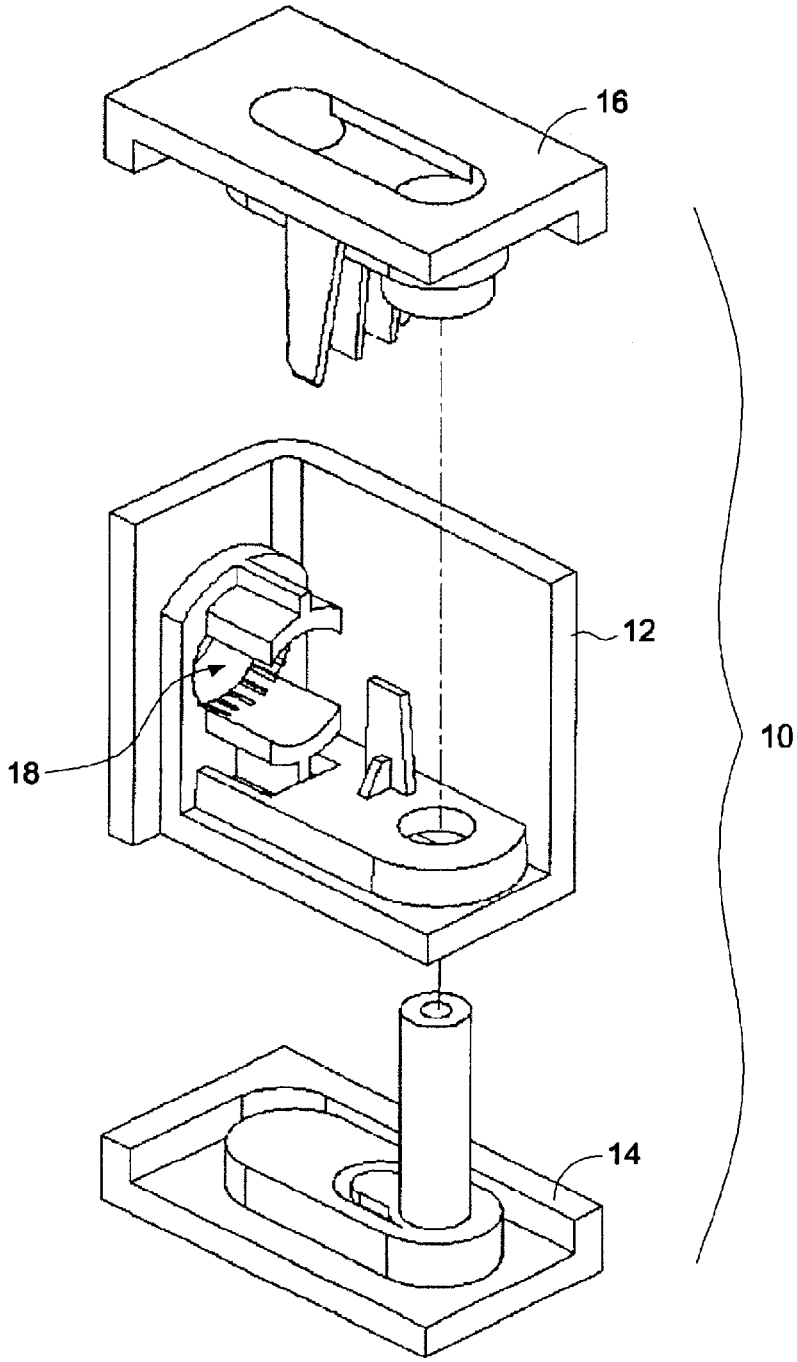
FIG. 1 is a perspective view of a universal antenna adapter according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

This invention provides a universal antenna adapter suitable not only for engaging with a fixed antenna but also for engaging with a detachable antenna. The universal antenna adapter can be installed on a wireless radio device or can be formed as a part of a wireless radio device. The universal antenna adapter comprises a fixed antenna connection structure and a detachable antenna connection structure so that a fixed antenna may engage with the fixed antenna connection structure while a detachable antenna may engage with the detachable antenna connection structure.

FIG. 1 is a perspective view of a universal antenna adapter according to one preferred embodiment of this invention. The universal antenna adapter 10 in FIG. 1 comprises a casing body 12, a base plate 14 and a cover plate 16. One side of the casing body 12 has a circular opening 18 for receiving a circular plug on a fixed antenna (detailed description later) or permitting a main body of a detachable antenna to pass through and screw onto an antenna connector (detail description later). The base plate 14 and the cover plate 16 are located on opposite sides of the casing body 12 so that the casing body 12 is tightly gripped between them. The universal antenna adapter 10 can be installed on a wireless radio device or can be formed as a part of a wireless radio device.

Figure 2A:
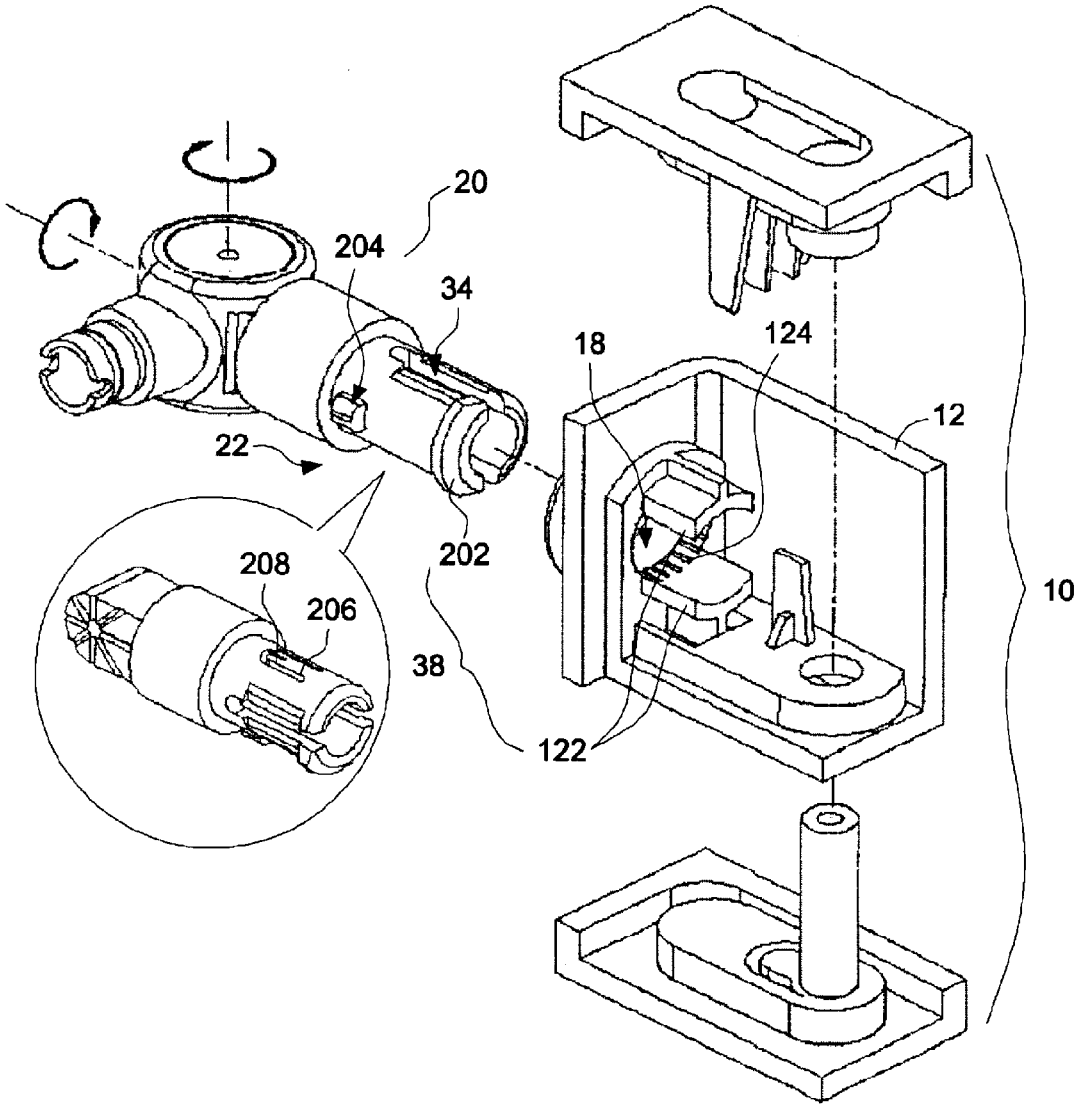
FIGS. 2*a* and 2*b* are perspective views showing the connection structure of a fixed antenna before and after engaging with a universal antenna adapter according to this invention as well as the method of engagement.
Figure 2B:
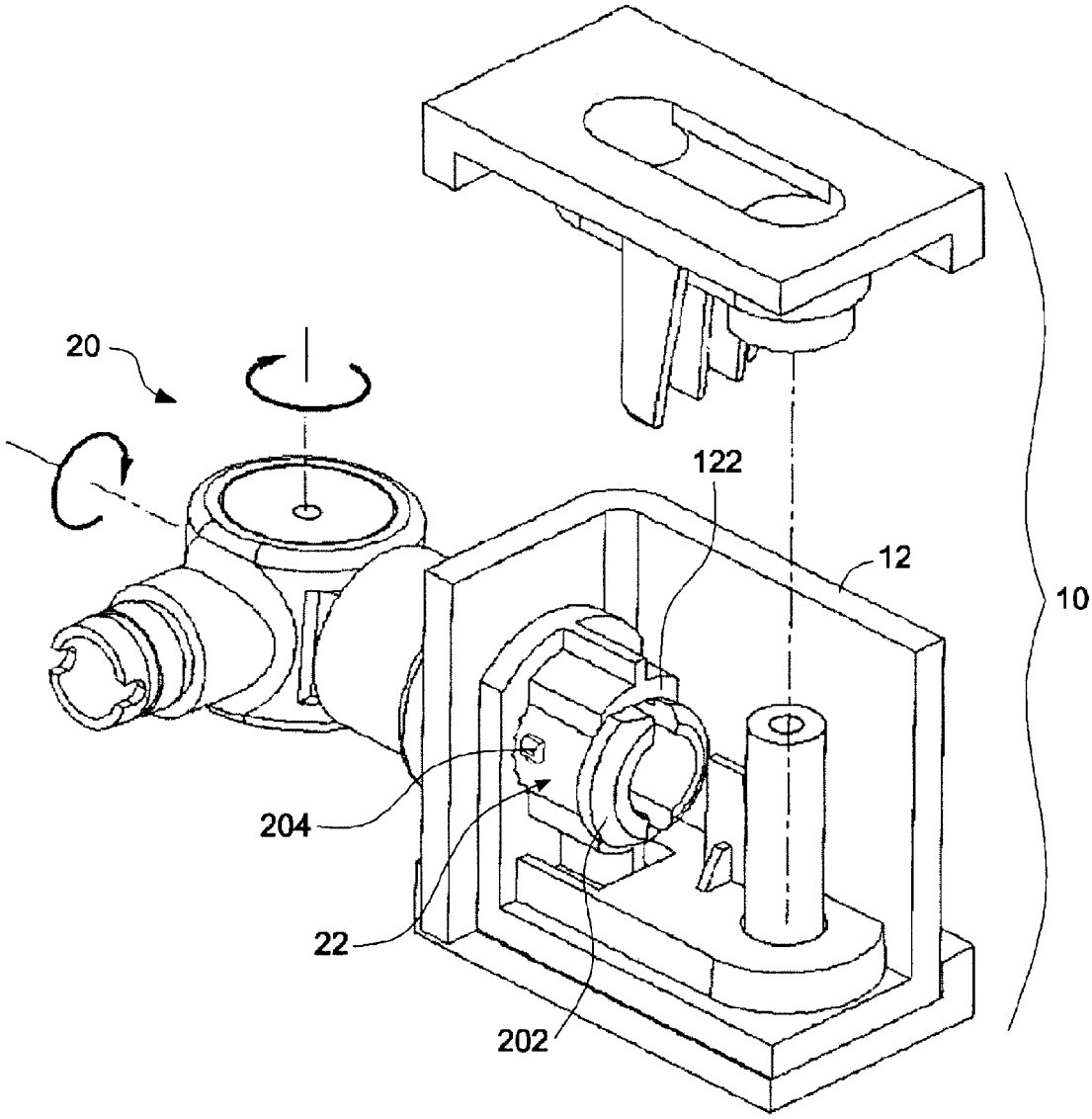

FIGS. 2*a* and 2*b* are perspective views showing the connection structure of a fixed antenna before and after engaging with a universal antenna adapter according to this invention as well as the method of engagement. As shown in FIG. 2*b*, the fixed antenna connection structure 38 is used for joining a fixed antenna 20 to the universal antenna adapter 10. The fixed antenna connection structure 38 comprises a latching spring plate 202 and a latching hook structure 122 as shown in FIG. 2*a*.

The circular plug 22 of the fixed antenna 20 has a pair of opposing longitudinal slots 34. In the presence of the longitudinal slots 34, one end of the circular plug 22 is joined together to form an integrated section while the other end of the circular plug 22 is split into an element with two equal sections. Utilizing the flexibility of side deflection of each split section, the circular plug 22 can be easily pushed into the opening 12 of the casing body 12. The latching spring plate 202 is set at the very end of the split section of the circular plug 22. The end of each split section may have a spring plate 202. Alternatively, one spring plate 202 may be attached to one of the split section only. The latching structure 122 is formed on an interior sidewall of the casing body 12 surrounding the circular opening 18. The latching structure 122 may comprises two symmetrically oriented split sections. When the split sections of the circuit plug 22 is inserted into the circular opening 18, the latching spring plate 202 also passes through the opening 28 and the latching hook structure 122. The spring plate 202 clicks onto the latching hook structure 122 so that the fixed antenna 20 and the universal antenna adapter 10 are locked in position.

For the aforementioned fixed antenna connector structure 38, the interior surface of the ring structure around the opening 18 of the casing 12 has a plurality of equally graduated grooves 124. A marking spring plate 206 is also installed on the circular plug 22 of the fixed antenna 20. Furthermore, a marking edge 208 is set on the surface at the movable end of the marking spring plate 206. Therefore, when the fixed antenna 20 rotates, the marking edge 208 may interfere with the graduated grooves in sequence so that a sense of graduated movement is produced through the marking spring plate 206.

In addition, an angle limiting spine 204 may also be attached to the surface of the circular plug 22. With the limiting spine 204 in place, rotation of the circular plug 22 will be stopped when the spine 204 comes into contact with the split symmetrical sections of the latching structure 122. Hence, the fixed antenna 20 is set to rotate within an angle delimited by the two symmetrically split sections of the latching hook structure 122.

Figure 3A:
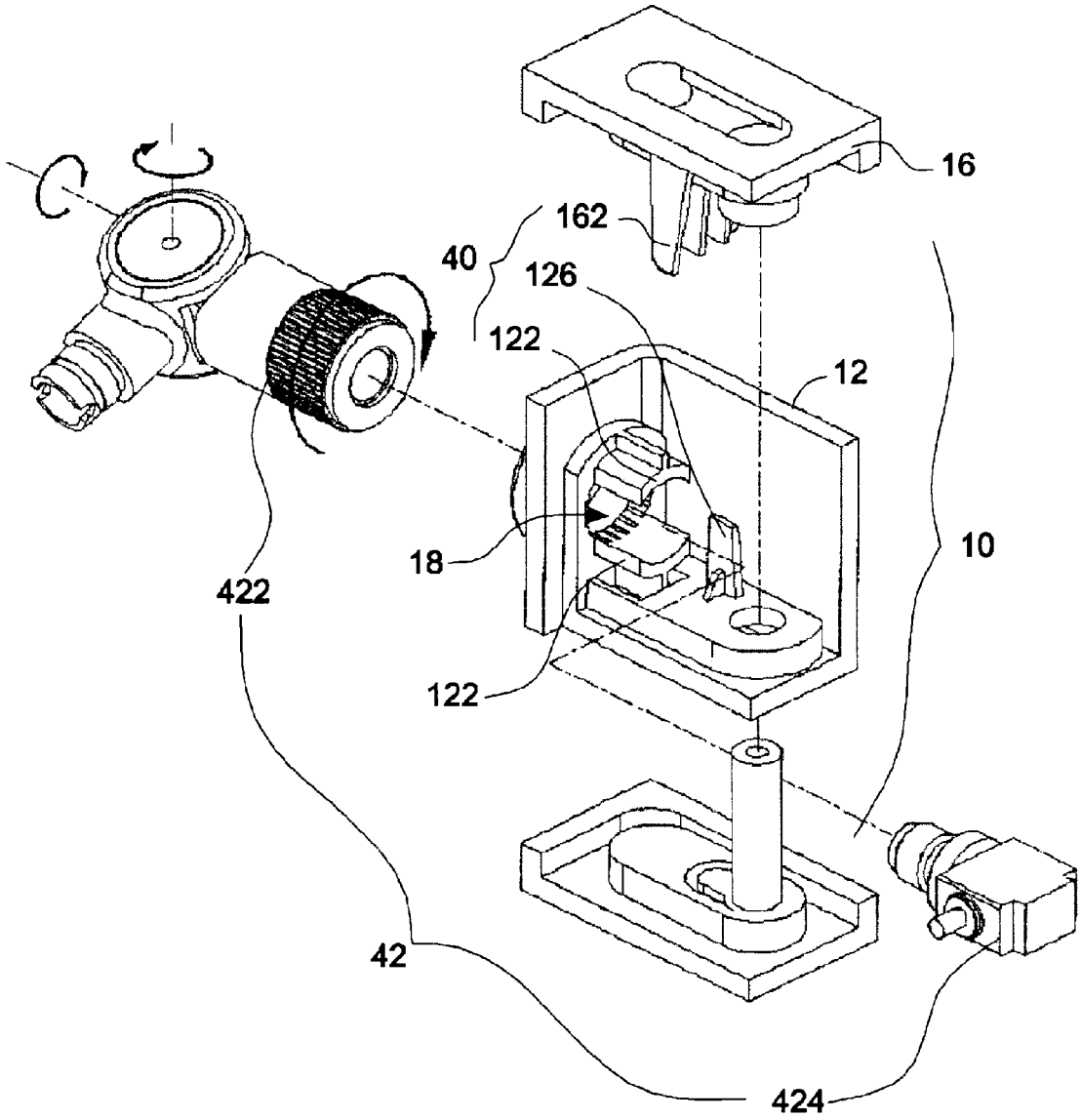
FIGS. 3*a*, 3*b*, 3*c* and 3*d* are perspective views showing the connection structure of a detachable antenna before and after engaging with a universal antenna adapter according to this invention as well as the method of engagement.
Figure 3B:
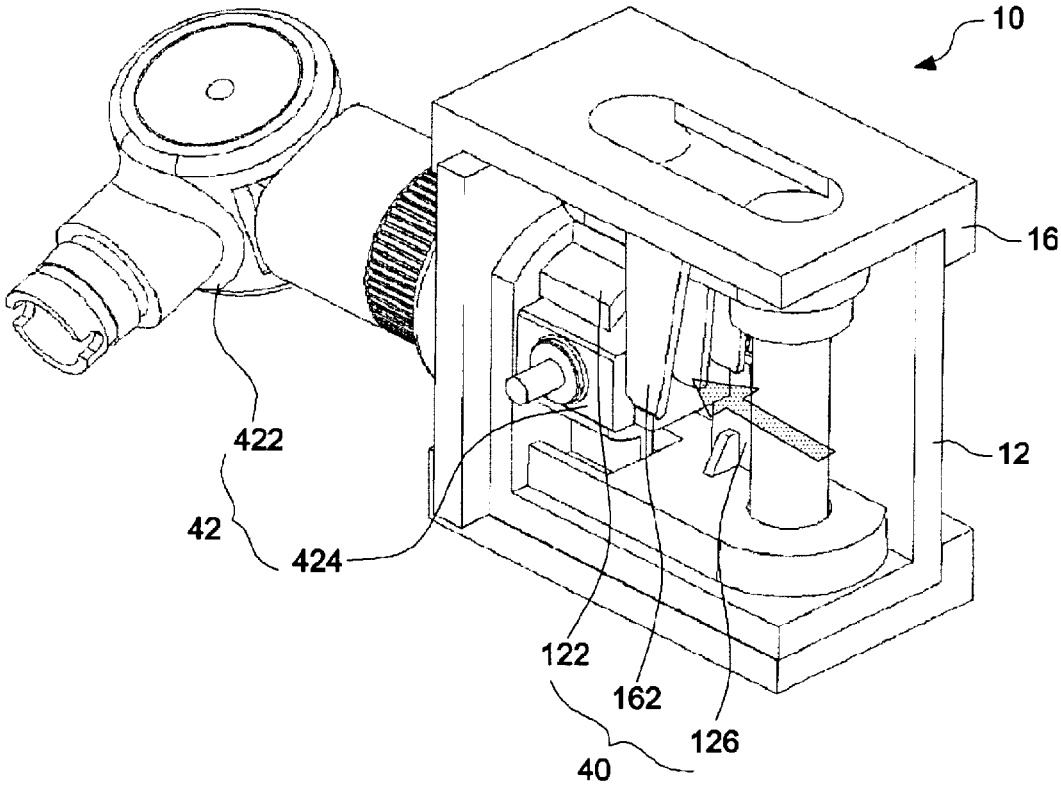

FIGS. 3*a*, 3*b*, 3*c* and 3*d* are perspective views showing the connection structure of a detachable antenna before and after engaging with a universal antenna adapter according to this invention as well as the method of engagement. As shown in FIGS. 3*a* and 3*b*, the detachable antenna connection structure 40 is used for joining a detachable antenna 42 to a universal antenna adapter 10. The detachable antenna 42 comprises an antenna main body 422 and an antenna connector 424.

Figure 3C:
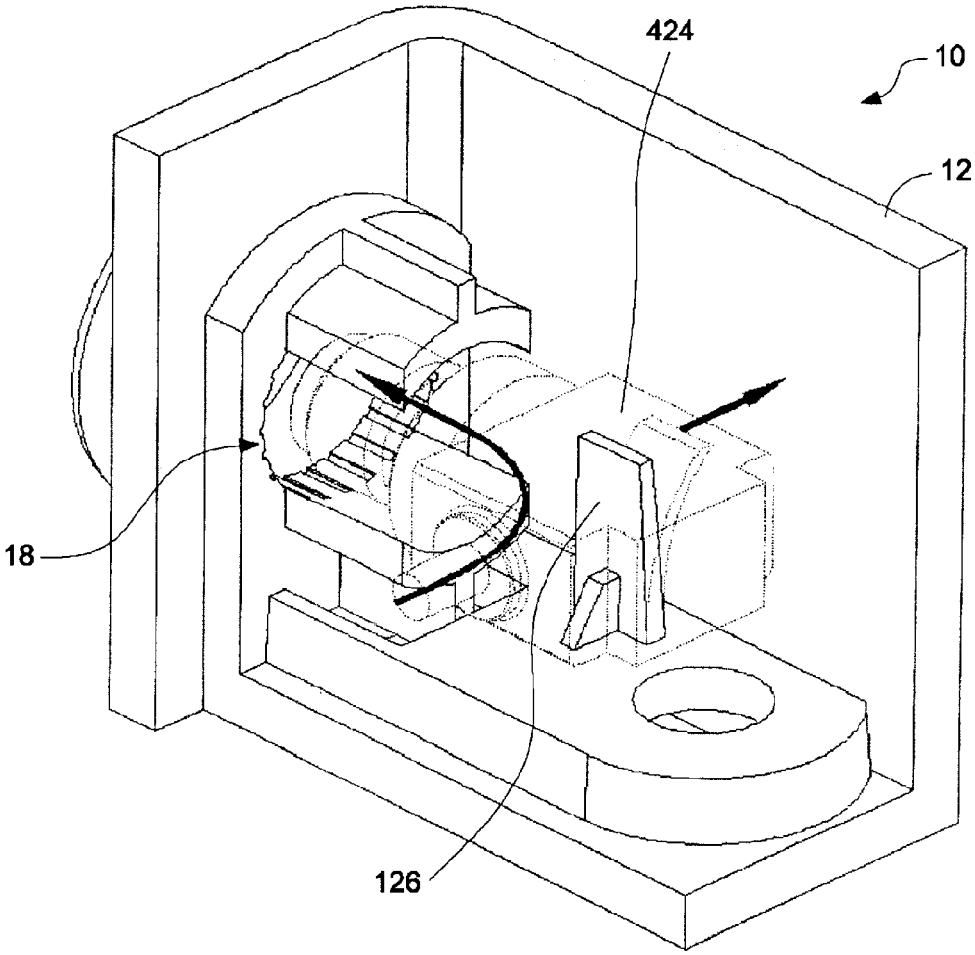

The detachable antenna connection structure has a fixed spring plate structure 126. The free end of the fixed spring plate structure 126 can deform elastically (as shown in FIG. 3c, in connection with FIGS. 3*a* and 3*b*). The fixed spring plate structure 126 is set on an interior surface of the casing body 12 for latching with the antenna connector 424. The interior surface where the circular opening 18 is positioned and the interior surface for holding the fixed spring plate structure 126 are perpendicular to each other. Through elastic deformation of the fixed spring plate structure 126 and subsequent return to its original position, the antenna connector 424 can easily slide into the circular opening 18 (as shown in FIG. 3*c*, in connection with FIGS. 3*a* and 3*b*) and lock inside the body casing 12. In other words, aside from locking the antenna connector 424 inside the universal antenna adapter 10, the fixed spring plate structure 126 also prevents the antenna connector 424 from moving backward and forward.

As shown in FIGS. 3*a* and 3*b*, the split symmetrical sections of the latching structure 122 around the circular opening 18 area is used for gripping and latching the antenna connector 424 so that the antenna connector 424 is prevented from rotation and up/down movement. At this stage, the antenna connector 424 may be pushed into the circular opening 18 and locked to one end of the antenna main body 422 using a screw so that the detachable antenna 42 and the universal antenna adapter 10 are joined together. Conversely, the antenna main body 422 of the detachable antenna 42 may be unscrewed from the antenna connector 424 so that the detachable antenna 42 is pulled away from the universal antenna adapter 10 at any time.

Figure 3D:
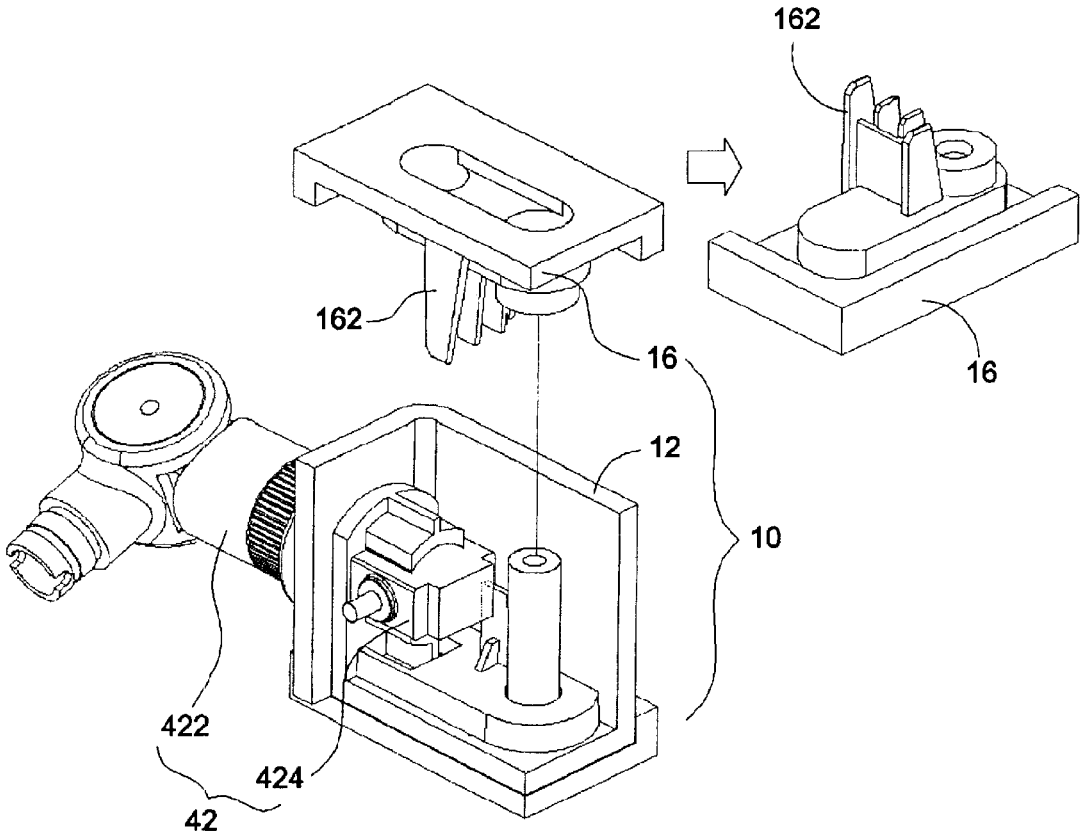

Furthermore, as shown in FIGS. 3*d*, 3*a* and 3*b*, a fixed blocking wall 162 is erected on the interior surface of the cover plate 16 of the universal antenna adapter 10. After assembling the cover plate 16 and the casing body 12 together, the fixed blocking wall 162 faces the circular opening 18 and contacts the antenna connector 424 of the detachable antenna 42. Thus, the forward and backward movement of the antenna connector 424 is further constrained.

In summary, the universal antenna adapter 10 is suitable for engaging with a fixed antenna 20 as well as a detachable antenna 42. In other words, the universal antenna adapter 10 encompasses the advantage of an easy installation and a firm attachment for a fixed antenna 20 and the advantage of repetitive assembling/disassembling for a detachable antenna 42. Moreover, a wireless radio device having the universal antenna adapter 10 has a greater compatibility for antennas so that the application range of the wireless radio device is expanded. In addition, only one set of molds is required so that the cost for producing the universal antenna adapter is reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A universal antenna a adapter for engaging with a detachable antenna, wherein the detachable antenna has an antenna body and an antenna connector, the universal antenna adapter comprising:

a circular opening for permitting one end of the antenna connector of the detachable antenna to pass through and engage with the antenna main body;

a latching hook structure set around the circular opening, wherein the latching hook structure clicks onto the antenna connector of the detachable antenna to prevent the antenna connector from rotation or up/down movement after inserting one end of the antenna connector through the circular opening; and a fixed spring plate set as a split latching hook structure such that the antenna connector is prevented from moving forward or backward after clicking onto the latching hook structure.

2. The universal antenna adapter of claim 1 wherein the adapter further comprises:

a body casing having at least two interior surfaces, wherein the circular opening is set on one interior surface and the fixed spring plate is set on the other interior surface; and a cover plate and a base plate for gripping the casing body.

3. The universal antenna adapter of claim 2, wherein the adapter further comprises a fixed blocking wall set on the cover plate for limiting the forward and backward movement of the antenna connector.

4. The universal antenna adapter of claim 3, wherein the fixed blocking wall faces the circular opening after the casing body is gripped between the cover plate and the base plate.

5. The universal antenna adapter of claim 2, wherein the interior surface with the circular opening and the interior surface with the fixed spring plate are perpendicular to each other.

6. The universal antenna adapter of claim 1, wherein the fixed spring plate deforms elastically to allow the passage of one end of the antenna connector through the circular opening and then snaps back automatically to lock the antenna connector and the latching hook structure together.

7. The universal antenna adapter of claim 1, wherein the main body of the detachable antenna passes through the circular opening and fastens to the antenna connector using screws.

* * * * *